United States Patent [19]

Kostylev et al.

[11] 3,955,631

[45] May 11, 1976

[54] SOIL SAMPLER

[76] Inventors: Alexandr Dmitrievich Kostylev, ulitsa Derzhavina, 19, kv. 44; Konstantin Stepanovich Gurkov, ulitsa Derzhavina, 19, kv. 13; Leonid Georgievich Rozhkov, ulitsa Krylova, 41, kv. 40; Khaim Berkovich Tkach, ulitsa Gogolya, 17, kv. 49, all of Novosibirsk; Evgeny Ivanovich Tanov, ulitsa Dzerzhinskogo, 34; Viktor Yakovlevich Ploschadny, prospekt Svobody, 5, kv. 11, both of Ashkhabad, all of U.S.S.R.

[22] Filed: Aug. 1, 1974

[21] Appl. No.: 493,857

[30] Foreign Application Priority Data

Aug. 29, 1973 U.S.S.R. ..... 1956669
Aug. 29, 1973 U.S.S.R. ..... 1957455

[52] U.S. Cl. ..... 175/20; 175/171; 175/387; 175/389; 175/405

[51] Int. Cl.[2] ..... E21B 11/02; E21B 9/16

[58] Field of Search ..... 175/5, 6, 19, 20, 1, 175/58, 135, 171, 173, 202, 203, 387, 389, 405

[56] References Cited

UNITED STATES PATENTS

| | | | |
|---|---|---|---|
| 2,176,477 | 10/1939 | Varney et al. | 175/6 |
| 2,283,650 | 5/1942 | Sanborn | 175/20 |
| 2,650,069 | 8/1953 | Rand | 175/6 |
| 2,807,439 | 9/1957 | Lipscomb | 175/6 |
| 3,154,158 | 10/1964 | Lincoln | 175/135 |
| 3,194,328 | 7/1965 | Fiore | 175/135 X |
| 3,313,357 | 4/1967 | Venghiattis | 175/6 |
| 3,373,826 | 3/1968 | Ingram | 175/58 X |
| 3,561,547 | 2/1971 | Pullos | 175/6 |
| 3,700,048 | 10/1972 | Desmoulins | 175/6 |

FOREIGN PATENTS OR APPLICATIONS

| | | | |
|---|---|---|---|
| 1,296,640 | 5/1962 | France | 175/135 |
| 634,680 | 9/1936 | Germany | 175/20 |
| 1,123,735 | 8/1968 | United Kingdom | 175/20 |

*Primary Examiner*—Frank L. Abbott
*Assistant Examiner*—Richard E. Favreau
*Attorney, Agent, or Firm*—Holman & Stern

[57] ABSTRACT

The present sampler is adapted to take soil samples from the ground surface, from a borehole sunk by other tools, as well as for drilling shallow boreholes. The sampler is provided with an air-operated percussion mechanism and a soil sample receiving sleeve arranged coaxially thereto. The side surface of the sleeve is provided with an annular ridge having a diameter somewhat larger than the diameter of the percussion mechanism housing. This feature enables a reduction of the forces applied to the sampler to sink it into or withdraw it from the soil.

2 Claims, 2 Drawing Figures

SOIL SAMPLER

BACKGROUND OF THE INVENTION

The present invention relates generally to field instruments for use in geological-engineering, prospecting and geological surveying work and has particular reference to soil samplers.

The invention can be applied in construction practice, geological exploration and in other fields whenever information of soil bedding and components is necessary.

The invention can find most utility when used for soil sampling and drilling rather shallow boreholes (up to 30 m deep) in loose and unstable soils.

PRIOR ART

One prior-art sampler extensively known to be used heretofore, comprises an enclosed air-operated percussion mechanism and a sample receiving sleeve rigidly interconnected thereto.

In the known device, the percussion mechanism has a hollow housing accommodating the gas distributor device. The housing carries a tapered endpiece rigidly held thereto, which in turn carries an adapter likewise rigidly fixed thereon, with the adapter being made integral with the crossarm which carries the soil receiving sleeves. Thus, the sleeves are arranged diametrally opposite with respect to the housing of the air-operated percussion mechanism so that the longitudinal axes of the both sleeves and of the housing are parallel.

Such an arrangement of the soil receiving sleeves with respect to the percussion mechanism housing results in that a drag is developed by the sampler when being sunk into the soil, as well as increased forces of friction of the sampler against the borehole walls, effective both in its penetration into and withdrawal from the soil. This is one of the disadvantages inherent in the construction of the known soil sampler.

In addition, the known soil sampler is practically inapplicable for sample taking in wet or unstable soils, since the borehole is liable to swell or crumble, thus hampering the compressed gas used-up in the percussion mechanism to exhaust.

OBJECTS AND SUMMARY OF THE INVENTION

It is a primary object of the present invention to provide a soil sampler having such a construction that makes it possible to increase the soil sampling rate, and render the sampler more efficient and economic.

The above and other objects are accomplished in a soil sampler, comprising a self-propelled air-operated percussion mechanism, a housing for the percussion mechanism and an anvil, a soil sample receiving sleeve rigidly interconnected to the housing, in which according to the invention, the air-operated percussion mechanism and the sample receiving sleeve are arranged coaxially one above the other, and the outside lateral surface of the sleeve is provided with an annular ridge spaced at least half the sleeve outside diameter from from its end remote from the percussion mechanism with the diameter of the ridge being somewhat in excess of the diameter of the housing.

The coaxial arrangement of the air-operated percussive mechanism and the sleeve contributes to a reduced soil resistance to the side surface of the sampler and enables a higher rate of its penetration into and withdrawal from the soil. Moreover, such an arrangement of the sampler components allows its overall dimensions and weight to be substantially reduced.

The purpose is attained by the provision of the annular ridge whereby the sampler withdrawing force is diminished.

In one of the embodiments of the present invention, the upper portion of the sleeve has a central axial blind hole for the sleeve to communicate with the anvil which partly extends into said hole, while both the anvil and the sleeve have through holes arranged perpendicular to their common axis and adapted to accommodate a pin retaining the sleeve during sampler withdrawal from the soil.

Such a joint between the percussion mechanism and the sleeve enables the latter to be set exactly along the longitudinal axis of the housing.

In another embodiment of the present invention, the air-operated percussion mechanism and the sleeve are accommodated in a protection shell to prevent the borehole walls from destruction, with the shell being fixed to the sleeve annular ridge, the mated surfaces of the sleeve and the shell shaped as a cone and an angle of flare thereof being somewhat smaller than the angle of friction between the material of the shell and that of the sleeve.

The protection shell prevents the borehole walls from crumbling and destruction in taking samples of loose or wet soils which substantially improves the sampler operation conditions. Moreover, the protection shell moves down together with the sampler as the borehole is sunk, thus enabling soil sampling at the required depth irrespective of the sleeve size.

Hence, the present soil sampler makes it possible to reduce the forces required for its penetration into and withdrawal from the soil and to take samples in loose and unstable soils.

An exemplary embodiment of the present invention is given below with reference to the accompanying drawings, wherein:

DETAILED DESCRIPTION OF THE EMBODIMENTS

The present sampler is intended to take soil samples from the ground surface, from a hole sunk by any other method, as well as for boring shallow holes. The device can be driven and sunk both vertically and at an angle.

Figure 1:
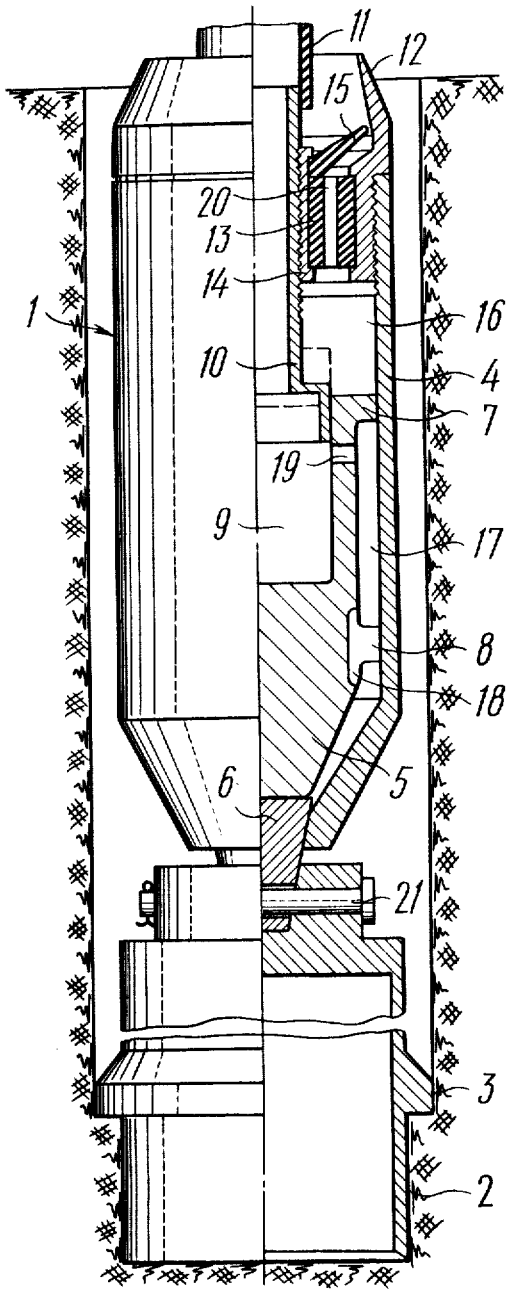
FIG. 1 is a fragmentary longitudinal axial section taken through a soil sampler according to the invention.

The soil sampler comprises an air-operated percussion mechanism 1 (FIG. 1) and a soil sample receiving sleeve 2 rigidly connected thereto.

The sleeve 2 and the air-operated percussion mechanism 1 are arranged coaxially to each other. An annular ridge 3 is provided on the outside lateral surface of the sleeve 2, spaced at least half the outside diameter of the sleeve from its end remote from the percussion mechanism 1 and adapted to reduce soil resistance to the sampler side surface during its penetration into and withdrawal from soil. This is why the diameter of the ridge 3 is somewhat greater than or in excess of the outside diameter of the sleeve 2 and that of the percussion mechanism 1.

Spacing of the annular ridge at least half the outside diameter from the end of the sleeve 2 is necessary in order that the forces of adhesion of the sleeve 2 with the soil effective on its portion confined within the end and the annular ridge 3 be high enough to keep the sampler against upward motion in the course of operation of the percussion mechanism 1. Should said spacing be less, the upward stroke of the striker of the percussion mechanism 1 will result in the sampler moving in a direction opposite to that occurring in its plunging into the soil.

The air-operated percussion mechanism 1 has a hollow cylindrical housing 4 which accommodates a striker 5 capable of reciprocating motion. A central axial tapered hole is provided in the bottom (as viewed in the Drawing) portion of the housing 4 to accommodate an anvil 6. The anvil 6 is essentially the frustum of a cone, with its minor base facing downwards and partly extending beyond the housing 4. Two collars 7 and 8 are spaced somewhat apart on the outside lateral surface of the striker 5, with the external surface of both of said collars being in constant contact with the inside surface of the housing 4. The striker 5 has a central cylindrical chamber 9 close to the top face thereof, with said chamber partly accommodating a spool 10 which is defined by a hollow stepped cylinder whose portion having a maximum diameter extends into the chamber 9 of the striker 5. A hose 11 is secured to the top (as viewed in the Drawing) portion of the spool 10 to supply compressed gas from, say, a compressor (not shown).

In this particular embodiment, use is made of the reversible percussion mechanism 1, and therefore provision is made in the top (as shown in the Drawing) portion of the housing 4 thereof for a nut 12 whose central hole accommodates a circular damper 13 which embraces a nut 14 provided on the portion of the spool 10 having a minimum diameter. Close to its upper face, the nut 14 has an annular flange to hold in between it and the end face of the damper 13, a ring valve 15 adapted to prevent foreign objects from penetrating into the housing 4 of the percussion mechanism 1.

Thus, a chamber 16 is defined between the surface of the chamber in the housing 4, the outside surface of the spool 10 and the end faces of the damper 15 and the striker 5, while the bottom (as viewed in the Drawing) portion of the surface of the chamber in the housing 4 and the outside surface of the striker 5 define a chamber 17. The chambers 16 and 17 are separated from each other by the collar 7 provided on the outside surface of the striker 5. The collar 8 has passageways 18 for air to flow.

In order to periodically communicate the chamber 17 with the chambers 16 and 9 during the stroke of the striker 5, ports 19 are provided in the walls thereof, whereas for communicating the chamber 16 with the atmosphere the circular damper 13 has a number of holes 20.

The top of the sleeve 2 has a central axial hole to communicate the sleeve with the housing 4 of the air-operated percussion mechanism 1. In this particular case the hole accommodates the portion of the anvil 6 which extends beyond the housing 4, and the hole in the top of the sleeve 2 is likewise tapered. When so embodied, the anvil 6 is essentially an integral piece with the housing 4 of the percussion mechanism 1. Both the anvil 6 and the sleeve 2 have through holes perpendicular to their common longitudinal axis, adapted for accommodating a pin 21 serving to fix the sleeve 2 with respect to the housing 4 and hold it when withdrawing the sampler from the soil.

Figure 2:
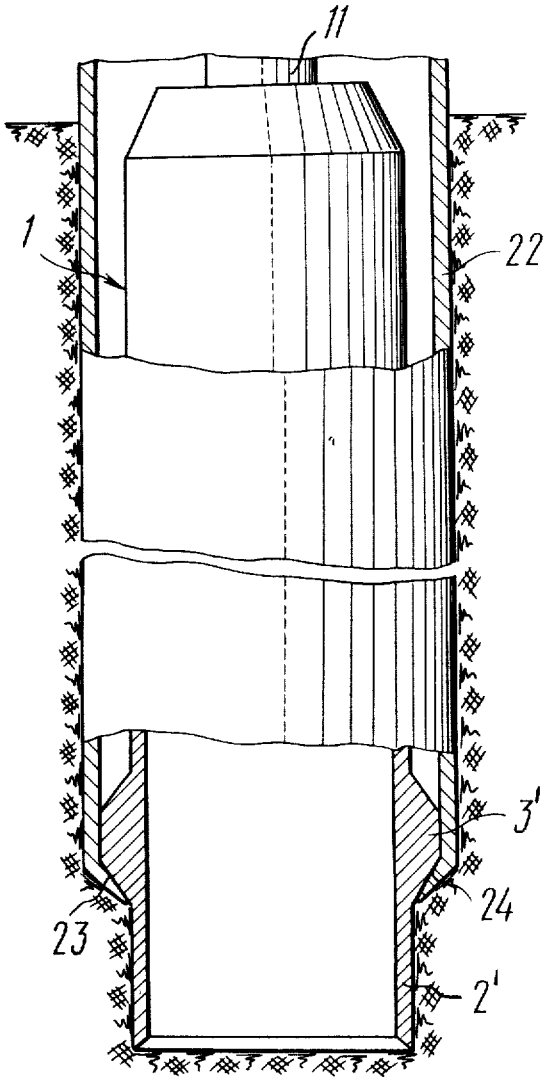
FIG. 2 is a fragmentary longitudinal sectional view in which a protection shell is provided for the percussion mechanism and sample receiving sleeve to prevent destruction or swelling of the borehole walls.

Whenever the present sampler is used to take samples of wet soil, use is made of a protective shell 22 (FIG. 2) which prevents the borehole walls from destruction or swelling during sample taking process. To secure the protection shell 22 on the sleeve 2', a portion 23 of its outside lateral surface located somewhat below (as viewed in the Drawing) the annular ridge 3', is tapered. The side surface of that portion is mated with a similarly tapered portion 24 of the inside surface of the protection shell 22. Thus, the sleeve 2' and the protection shell 22 have their respective portions 23 and 24 shaped as a cone which faces, with its base, the percussion mechanism 1 and having an angle of flare somewhat smaller than the angle of friction between the material of the shell 22 and that of the sleeve 2'. Such an angle of flare is so selected as to ensure that the sleeve 2' is locked in the shell 22 when the sampler is sunk into soil.

When, in the initial position, the sampler is positioned in a predetermined direction with respect to the ground surface, or plunged into the borehole, the striker 5 rests upon the anvil 6 and its port 19 inter communicate the chambers 9 and 17.

The sampler operates as follows. Compressed gas from the compressor (not shown) is fed through the hose 11 to the spool 10 to fill the chamber 9 in the striker 5. Further on, compressed gas passes through the ports 19 in the side wall of the striker 5 to fill the chamber 17, passing into its bottom (as viewed in the Drawing) portion through the passageways 18 provided in the collar 8.

Due to a differential gas pressure exerted upon the lower (as viewed in the Drawing) end face of the striker 5 and upon the bottom of the chamber 9 whose area is less than that of the end face of the striker 5, the latter starts ascending with the result that the spool 10 with its lateral surface overruns the ports 19 to stop gas feeding into the chamber 17. Further ascending of the striker 5 goes on by virtue of expansion of the compressed gas in the chamber 17 until the striker ports 19 are above the portion of the spool 10 having a maximum diameter. Thereupon, compressed air from the chamber 17 makes its way through the ports 19 into the chamber 16 and escapes into atmosphere through the holes 20 in the damper 13, i.e., an exhaust occurs, whereby the striker 5 performs the downstroke. The downstroke of the striker 5 occurs by virtue of the compressed gas pressure effective in the chamber 9, as well as due to the gravitational force of the striker 5 per se, and terminates in its impact against the anvil 6. Thus, the sleeve 2 is urged to sink into the soil. At the instance of the striker impact against the anvil 6 the ports 19 of the striker 5 regain communication of the striker chamber 9 with the chamber 17 to fill again the latter with compressed air, whereby the striker 5 is caused to rise. Thus, the entire operating cycle of the percussion mechanism 1 is repeated. The working procedure of the percussion mechanism 1 is recycled until the soil sample column fills the sleeve 2 to full capacity.

When the sleeve 2 penetrates into the soil, the forces of friction of its bottom (as viewed in the Drawing) cylindrical portion and those of the annular ridge 3 against the borehole walls are much less as compared to those occurring in sinking the sampler of the known construction, whereby the rate of the sampler penetration into the soil is increased and, consequently, its efficiency is increased accordingly.

Upon filling the sleeve with sampled soil, compressed gas is no longer fed into the sampler.

In order to extract the sampler from the borehole, the hose 11 is rotated to turn back the spool 10 from the nut 14 for a length approximately equal to half its portion having a maximum diameter. As a result when compressed gas is fed into the chamber 9 and further on, through the ports 19 into the chamber 17 the striker 5 starts ascending due to the differential gas pressure exerted upon the striker bottom (as viewed in the Drawing) end face and upon the bottom of the chamber 9 which are different in area.

The upstroke of the striker 5 goes on until its ports 19 raise above the portion of the spool 10 having a maximum diameter. In virtue of the fact that the spool 10 assumes another position in the housing 4, communication of the chamber 17 through the port 19 with the chamber 16 and, consequently, with atmosphere occurs later than in the case of sampler penetration into the soil. This is why the striker 5 has no time to brake by gas pressure effective in its chamber 9 and therefore will strike against the bottom (as viewed in the Drawing) face of the nut 12.

The downstroke of the striker 5 occurs due to the compressed gas pressure effective in the chamber 9, as well as under gravitational force of its own. As a result of a new position assumed by the spool 10, the chamber 17 communicates through the ports 19 and the chamber 9 with the source of compressed gas earlier than in the case of the sampler penetration into the soil and, therefore, the striker 5 will brake before it manages to strike against the anvil 6. Further on, the operating procedure of the air-operated percussion mechanism 1 is recycled until the sampler is completely withdrawn from the borehole. The provision of the annular ridge on the side surface of the sleeve 2 reduces substantially the sampler surface in contact with the borehole walls, whereby higher rate of sampler extraction is attained.

Whenever sample taking is carried out in loose or unstable soils, use is made of the protection shell 22, which is mounted onto the sleeve 2' until a complete mating of the tapered surfaces of the sleeve 2' and those of the protection shell 22 occurs on the respective portions 23 and 24. Thus, both the air-operated mechanism 1 and the sleeve 2' are enclosed in the protection shell 22.

When the air-operated percussion mechanism 1 functions, the sleeve 2' is impacted into the soil and entrains the protection shell 22 into the borehole so that the shell moves along with the sampler as the borehole is established and prevents its walls from destruction or swelling.

When withdrawing the sampler from the borehole, the protection shell 22 is left therein, since the forces of adhesion with soil effective on the shell outside surface are much superior to the forces of adhesion of the shell 22 with the sleeve 2', effective on their respective portions 23 and 24. Due to this fact a possibility is provided to take soil samples repeatedly from the same borehole regardless of the kind and condition of the soil.

In this case, the work of the air-operated percussion mechanism 1, both when sinking the sampler into or withdrawing it from soil, is similar to that described hereinbefore.

What we claim is:

1. A soil sampler comprising: a self-propelled air-operated percussion mechanism; a housing for said air-operated percussion mechanism and an anvil; a soil sample receiving sleeve rigidly connected with said housing of the air-operated percussion mechanism; said sleeve and said percussion mechanism being arranged coaxially one above the other; said sleeve having an outside lateral surface; an annular ridge on the outside surface of said sleeve and spaced at least half the outside diameter of said sleeve from its end remote from said percussion mechanism, with the diameter of said ridge being somewhat in excess of the diameter of said housing, the annular ridge serving to facilitate removal of the samples from the borehole, the sleeve having an upper portion, a central axial blind hole in the upper portion to communicate the sleeve with the anvil, the anvil partly extending into said blind hole, through holes provided in the anvil and in the sleeve, said through holes being arranged perpendicularly to the common axis thereof and a pin accommodated in the through holes, with the pin retaining the sleeve during sampler extraction from the soil.

2. A soil sampler comprising: a self-propelled air-operated percussion mechanism; a housing for said air-operated percussion mechanism and an anvil; a soil sample receiving sleeve rigidly connected with said housing of the air-operated percussion mechanism; said sleeve and said percussion mechanism being arranged coaxially one above the other; said sleeve having an outside lateral surface; an annular ridge on the outside lateral surface of said sleeve and spaced at least half the outside diameter of said sleeve from its end remote from said percussion mechanism, with the diameter of said ridge being somewhat in excess of the diameter of said housing, the annular ridge serving to facilitate removal of the samples from the borehole, a protection shell in which the air-operated percussion mechanism and the sleeve are enclosed, the protection shell being adapted to prevent borehole walls from destruction and being held to the sleeve annular ridge, the sleeve and shell having mating surfaces, the mating surfaces of the sleeve and shell being shaped as a cone and an angle of flare thereof being somewhat smaller than the angle of friction between the material of the shell and that of the sleeve.

* * * * *